United States Patent [19]

Weaver

[11] Patent Number: 4,622,542

[45] Date of Patent: Nov. 11, 1986

[54] MAGNETIC ARTICLE SURVEILLANCE SYSTEM, METHOD AND CODED MARKER

[75] Inventor: Jon N. Weaver, Lake Park, Fla.

[73] Assignee: Controlled Information Corporation, Lake Park, Fla.

[21] Appl. No.: 748,997

[22] Filed: Jun. 26, 1985

[51] Int. Cl.[4] ..... G08B 13/18

[52] U.S. Cl. ..... 340/572; 340/551

[58] Field of Search ..... 340/572, 551; 343/5 PD

[56] References Cited

U.S. PATENT DOCUMENTS

| | | | |
|---|---|---|---|
| 3,292,080 | 12/1966 | Trikilis | 324/200 |
| 3,665,449 | 5/1972 | Elder et al. | 340/572 |
| 3,747,086 | 7/1973 | Peterson | 340/572 |
| 3,765,007 | 10/1973 | Elder | 340/572 |
| 3,790,945 | 2/1974 | Fearon | 340/572 |
| 3,803,571 | 4/1974 | Luz | 340/573 |
| 3,820,090 | 6/1974 | Wiegand | 340/551 |
| 3,820,103 | 6/1974 | Fearon | 340/572 |
| 3,820,104 | 6/1974 | Fearon | 340/572 |
| 3,891,980 | 6/1975 | Lewis et al. | 340/572 |
| 3,938,125 | 2/1976 | Benassi | 340/572 |
| 3,983,552 | 9/1976 | Bakeman, Jr. et al. | 340/572 |
| 4,134,538 | 1/1979 | Lagarde et al. | 235/449 |
| 4,298,862 | 11/1981 | Gregor et al. | 340/572 |
| 4,309,697 | 1/1982 | Weaver | 340/572 |
| 4,384,281 | 5/1983 | Cooper | 340/572 |
| 4,413,254 | 11/1983 | Pinneo et al. | 340/572 |
| 4,489,313 | 12/1984 | Pfister | 340/572 |

*Primary Examiner*—Glen R. Swann, III

*Attorney, Agent, or Firm*—Steele, Gould & Fried

[57] ABSTRACT

A surveillance system is based upon generation and detection of phase shifted harmonic signals responsive to transmission of a reference signal at a fundamental frequency in a detection zone. Phase shifted harmonic signals may be generated by markers comprising a core of soft magnetic material and an electrically conductive material at least partly surrounding the core. Phase shifted harmonics are not accidentally generated by biassed ferrous alloys, the cause of most system failures.

17 Claims, 5 Drawing Figures

MAGNETIC ARTICLE SURVEILLANCE SYSTEM, METHOD AND CODED MARKER

BACKGROUND OF THE INVENTION

1. Field of the Invention

The invention relates to magnetic article surveillance systems, and coded markers for such systems, which are capable of generating and distinguishing among large numbers of codes.

2. Statement of Art

Article surveillance systems using soft magnetic materials and low frequency detection systems have been known since the Picard patent (Ser. No. 763,861) was issued in France in 1934. Picard discovered that when a piece of metal is subjected to a sinusoidally varying magnetic field, an induced voltage, characteristic of the metal composition, is produced in a pair of balanced coils in the vicinity of the applied field. Today, such systems utilize the harmonics produced by a marker of soft magnetic strip to detect the marker. Due to the nonlinear characteristics of such markers, groups of even and odd order harmonics can be produced simultaneously or individually. Odd order (1, 3, 5 . . . ) harmonics are produced by a symmetrical switching of the B/H loop. Even order harmonics (2, 4, 6 . . . ) are produced by a non-symmetrical switching condition, typically caused by a D.C. magnetic bias internal or external to the material.

The nonlinear characteristics of the soft magnetic material, while not commonly found, can be duplicated is some ferrous alloys by the presence of a magnetic bias. This results in the generation of even and odd order harmonics that duplicates the response of soft magnetic materials, such as permalloy and the metallic glass products. However, the use of more sensitive detection equipment can add to the probability of false alarms due to ferrous alloys.

Another limitation of the soft strip and low frequency system is that only a single bit of information is available during marker and system interaction. The marker is either in the detection zone, or not. The only other alternative is that the marker is, whether or not in the detection zone, deactivated. While this is not a disadvantage for systems used in theft control, it is an extreme limitation when used for monitoring the flow of a group of differing objects, or even persons, through the detection zone.

Those systems using coded devices for monitoring people and articles in a selected area are quite capable of a large number of codes. Card access systems are a good example. They generally combine a digital network and/or radio frequency circuit to transmit the code. However, these devices are too expensive to use either for theft control of low cost items or for inventory control in factories or stores. It is understood that encoded markers can be affixed to or otherwise carried by any article or person, animal, etc. The term "article" is used herein to encompass such possibilities.

This invention differs from the prior art in that the codes utilized are not duplicated by biased ferrous alloys, even accidentally. Further, the coded marker can be embodied in a single element device and can be programmed (code changed) by altering the geometry of or extent of a conductor surrounding a magnetic core. It is detectable at large distances and is not sensitive to spatial orientation within the system. The number of codes does not depend on the marker structure but on the phase resolution of the detection system and programming device.

The concept of this invention can best be appreciated in contrast to the teachings of specific and representative patents. The prior art can be broken down into the following classifications: (1) single element; (2) multiple element (3) biased (magnetized); and, (4) unbiased.

A bistable magnetic device is disclosed in U.S. Pat. No. 3,820,090-Wiegand. The marker is in the form of a wire, preferably with a magnetically "hard" magnetized outer shell (having a relatively high coercivity) and a moderately "soft" magnetic core (having a relatively low coercivity). The magnetized shell portion is operable for magnetizing the core portion in a first direction, the magnetization of the core portion is reversible by application of a separate magnetic field and the shell is operable to remagnetize the core portion in the first direction upon removal of the separate magnetic field. The device requires a fixed orientation to the interrogation field. The system can produce additional codes only by using multiple elements. Such devices are generally used for close proximity card access systems.

The device disclosed in U.S. Pat. No. 3,747,086-Peterson uses multiple elements to bias a soft magnetic strip. The marker comprises a plurality of ferromagnetic elements including a first element capable of generating a signal containing harmonics of an exciting oscillatory interrogating field and a seond element having a coercive force greater than the first element and capable of retaining a state of magnetization when exposed to the interrogation field, such that when so magnetized, a magnetic bias is imposed on the first element to prevent the generation of the harmonic signal. Four possibilities (codes) exist depending on which element is magnetized. However, these codes are easily reproduced in any biased, ferrous alloy. The system is neither unique nor reliable.

The system disclosed in U.S. Pat. No. 3,765,007-Elder uses markers of "n" number of elements with differing AC coercivities to produce "n" number of codes. When the elements are subjected to a periodically varying magnetic field, the magnetization of the elements reverses sequentially at equal intervals of time. Like Peterson, Elder's system is prone to false alarms from biased, ferrous alloys which inadvertently, and all to frequently, duplicate the code. Moreover, a plurality of magnetic field producing means must be used to cover all orientations of the coded elements (markers).

The system disclosed in U.S. Pat. No. 4,134,538-Lagard, et al. uses markers of "n" multiple elements or bands producing varying amplitudes as a code. Such magnetic bands are selectively divided at variable predetermined locations by cuts of variable predetermined extent, such that when in the detection zone, signals of varying amplitudes are produced. The marker must pass correctly oriented and in close proximity to the coils in the detection zone. It is primarily a device intended for access or inventory control and is expensive to produce.

This invention is based upon the discovery that when a suitable conductor, such as aluminum or copper, partially or totally encloses a core of soft magnetic material, the phase of the harmonics produced will be shifted (delayed in time). The amount of phase shift induced is controlled largely by the amount and resistivity of the conductor surrounding the magnetic material. It is feasible to shift any harmonic or groups of harmonics by any amount, through 360 degrees. However, some loss of harmonic amplitude is encountered as the conductor thickness increases and as the harmonic number increases.

The ability to control harmonic phase permits the generation of signals having a unique signature, apart from both ferrous alloys and soft magnetic materials. This avoids the accidental detections plaguing prior art systems as described above. In addition, a number of codes can be established according to the phase shift induced. The phase shift is not affected by a low level, external magnetic bias, in that odd order products are totally unaffected and even products shift by +/−180 degrees.

The system comprises an oscillator which provides phase locked signals to a transmitter/amplifier circuit and receiver/phase comparator circuit. Phase shifted harmonic generated by the marker are captured and amplified in the receiver. A comparison is made only of the phase of the received harmonics to the phase of the transmitted signal. Either one or more harmonics may be compared depending on the particular system use. A system used for theft control device requires a minimum code level but a maximum number of harmonic phase comparisons. A system used for inventory control would require a maximum number of codes but a minimum number of phase comparisons. Once the phase shift is compared and found to be correct (in the case of a theft system for example) an alarm is sounded. An inventory control system would have further processing equipment to send data to a cash register or a computer, to actuate a mechanical/electrical device or a combination thereof.

SUMMARY OF THE INVENTION

It is an object of this invention to provide an article surveillance system utilizing encoded magnetic markers adapted to be carried by articles or persons to be monitored in a detection zone.

It is another object of this invention to provide a method for monitoring articles or persons carrying encoded magnetic markers in a detection zone.

It is still another object of this invention to provide an encodable magnetic marker, capable of coding for large numbers of different codes It is yet another object of this invention to provide more reliable detection of encoded magnetic markers in article surveillance systems.

It is yet another object of this invention to provide improved article surveillance systems and encodable magnetic markers for such systems, based upon detection of the phase shifted harmonics of a phase locked reference signal of a fundamental frequency, and the degree of the phase shift.

These and other objects are accomplished by a magnetic article surveillance system, comprising: means for generating and transmitting phase locked reference signals at a fundamental frequency in a detection zone; a plurality of coded markers, each marker having means for generating phase shifted harmonic signals responsive to the phase locked reference signals at the fundamental frequency; means for receiving the phase shifted harmonic signals generated by coded markers in the detection zone; means for determining the relative phase shift between the reference signals and the harmonic marker signals; and, means for generating a control signal responsive to identification of a valid code by the determing means. In a theft determining system, for example, the surveillance system may further comprise means for comparing a determined relative phase shift to a predetermined phase shift, for enabling a yes/no detection signal to be generated by the control signal generating means. In an inventory control system, for example, the surveillance system may further comprise: means for precisely measuring the degree of relative phase; and, means for generating a variable control signal corresponding to the measured degree of relative phase shift. Each of the markers comprises means for adjusting the degree of phase shift of the harmonic signals. In particular, each of the markers may comprise a core of soft magnetic material at least partly surrounded by an electrically conductive material, the degree of phase shift being proportional to the amount and thickness of the electrically conductive material, relative to the amount of core material, to the configuration of the electrically conductive material and to the resistivity of the electrically conductive material.

These and other objects are also accomplished by a method for conducting surveillance of articles or persons in a detection zone, comprising the steps of: providing each article or persons with a coded marker having means for generating phase shifted harmonic signals responsive and relative to reference signals; transmitting phase locked reference signals at a fundamental frequency into the detection zone; receiving phase shifted harmonic signals generated by each marker in the detection zone responsive to the phase locked reference signals; and, measuring the phase shift between the reference signals and the harmonic marker signals, the degree of the phase shift being related to positive identification of a marker in the detection zone. In a theft detection system, for example, the method may further comprise the step of generating a control signal responsive to identification of a coded marker in the detection zone. In an inventory control system, for example, the method may further comprise the steps of: forming each of the markers from a core of soft magnetic material surrounded by an electrically conductive material; encoding the markers with different codes; and, generating a variable control signal corresponding to the measured degree of phase shift of the detected harmonic signals. The markers can be variably encoded by adjusting at least one of the amount of and/or thickness of the electrically conductive material relative to the amount of core material; the configuration of the electrically conductive material; and, choosing the electrically conductive material according to its characteristic resistivity. The degree of phase shift is proportional to each of the amount, the configuration and the resistivity.

These and other objects of the invention are further accomplished by a magnetic marker for use in articles surveillance systems wherein coded markers are carried by monitored articles, the marker comprising: a core of soft magnetic material; and, an electrically conductive material at least partly surrounding the core, whereby the marker will generate a clearly identifiable signal of phase shifted harmonics responsive and relative to a phase locked reference signal of a fundamental frequency, the degree of phase shift enabling reliable detection and identification of each coded marker. The core material may be chosen from permalloy or any of the known metallic glass materials. The electrically conductive material may be any of the known electrical conductors, relatively inexpensive and presently preferred materials being copper and aluminum. The electrically conductive material may be continuous, or may comprise discrete sections of electrically conductive material. The core may have any one of a number of configurations or cross-sections, including but not limited to those of a wire, rod, ribbon and plate. The electrically conductive material may have any one of a number of configurations, including but not limited to being wrapped around the core, being a plurality of rings encircling the core or being a sheet with an aperture through which the core material is disposed.

BRIEF DESCRIPTION OF THE DRAWINGS

Presently preferred embodiments of the invention are shown in the following drawings, it being understood, however, that the invention is not limited to the precise arrangements and instrumentalities shown.

DETAILED DESCRIPTION OF THE PREFERRED EMBODIMENTS

Figure 1:
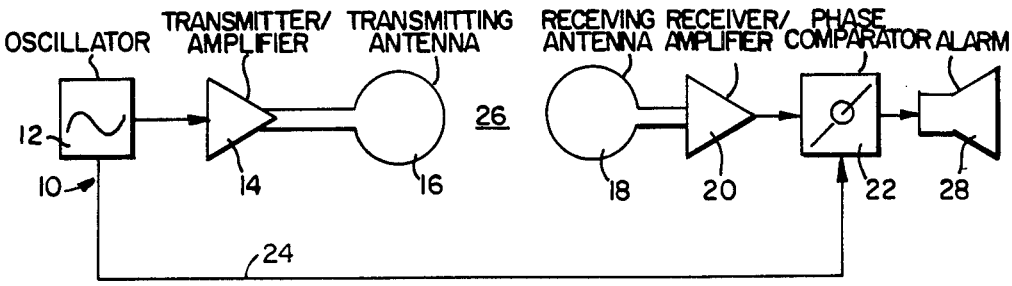
FIG. 1 is a block diagram of a theft control surveillance system according to this invention.

An article surveillance system 10 according to this invention is shown in block diagram form in FIG. 1. For purposes of simplicity, the system illustrated is a theft detection system rather than, for example, an inventory control system. The oscillator 12 generates signals which are phase locked to one another and which are exact multiples of the fundamental frequency being transmitted. The fundamental frequency is relatively free of harmonic distortion. The fundamental signal is applied to the transmitter/amplifier 14 where it is amplified. The amplified signal is coupled to the transmitter antenna 16 which is composed of one or more turns of copper wire. The resultant transmitted signal is preferably a substantially pure sine wave of electromagnetic energy and is within a preferred frequency range of 100 Hz to 10,000 Hz.

One or more phase locked reference signals are coupled from the oscillator 12 to the phase comparator 22 by a connection 24. The receiver antenna 18 is composed of one or more turns of copper wire and is coupled to a receiver/amplifier 20.

The receiver/amplifier 20 amplifies and filters all received signals until only one or more of the harmonics of the fundamental frequency are present. The harmonic(s) are coupled to the phase comparator 22 where a direct comparison is made to the reference signal(s). When the system is used for theft detection, a correct phase correlation between received and reference signals will cause the phase comparator 22 to produce an output to the alarm indicator 28. The alarm may be an audible or visual signal or a combination of both.

When the system is used for monitoring access or inventory, markers effecting different degrees of phase shift will pass through the detection zone of the system. The signal generated by each marker will have a different phase orientation to the reference signal. This difference will be detected by the phase comparator, and depending upon the application information, may be transferred to a cash register, computer, electromechanical actuator or any combination of these.

Figure 2:
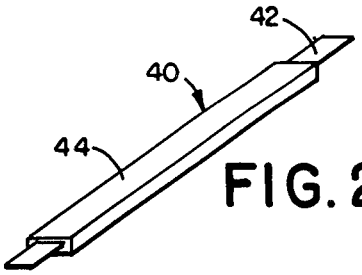
FIG. 2 is a perspective diagrammatic view of a marker according to this invention, made from soft magnetic material and surrounded by a conductor.
Figure 3:
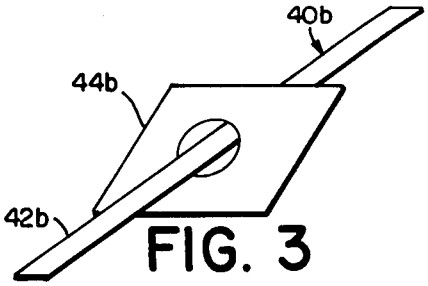
FIG. 3 is a perspective diagrammatic view of an alternative embodiment of a marker, wherein a soft magnetic strip is enclosed by a sheet of conductive material.
Figure 4:
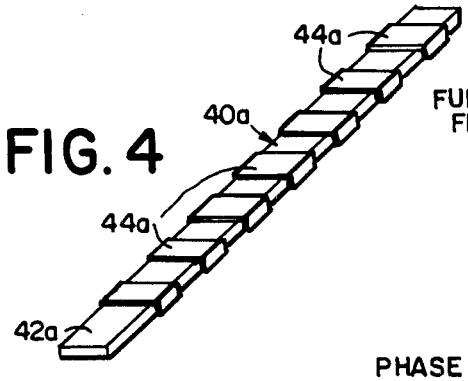
FIG. 4 is a perspective diagrammatic view of a further alternative embodiment of a marker, wherein a soft magnetic strip is enclosed by rings of conductive material.

With reference to FIG. 2, a marker according to this invention is generally designated 40. The marker 40 has a core 42 of soft magnetic material, for example permalloy or any of the metallic glass materials. The core is least partly surrounded by an electrically conductive material 44, for example copper or aluminum. Merely by way of example, and without limitation, a typical ribbon-form core may be 7.5 cm long, 0.25 cm wide and 0.0025 cm thick. The conductor 44 may be wrapped around the magnetic material or may be plated, evaporated or sputtered directly on the magnetic core 42. The magnetic material may be in the form of a plate, strip (ribbon), rod or wire. The application of conductive material may be continuous or may be distributed in discrete sections. An example of the latter is the marker **40*a* shown in FIG. 4. A magnetic core 42*a* of soft magnetic material is surrounded by a plurality of discrete rings 44*a* of electrically conductive material. Each ring would define or cause an incremental shift in phase for the marker, greatly simplifying an encoding process. Shifting the phase of a marker from one phase orientation to another could be accomplished as shown in the marker 40*b* illustrated in FIG. 3, wherein the core 42*b* of soft magnetic material passes through a hole in a conductive sheet 44*b***.

Figure 5:
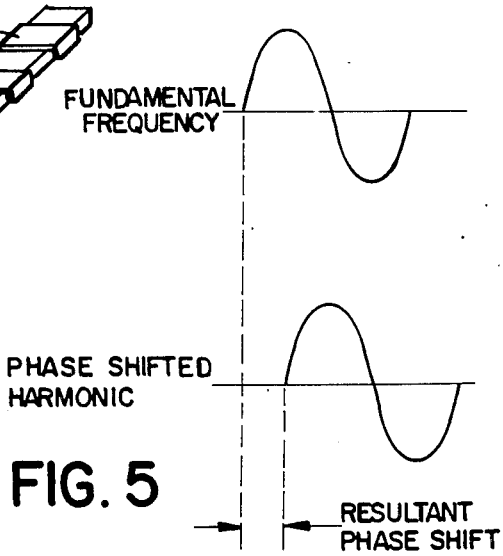
FIG. 5 is a diagrammatic representation showing a harmonic shifted relative to its original state.

A representation of the phase shift (delay) of a marker harmonic when a conductor encloses a soft magnetic material is shown in FIG. 5. A phase shift of almost any value can be produced from 0 degrees through 360 degrees. The only limiting factor is that the greater the shift, the greater the attenuation of the amplitude of the harmonic produced by the markers.

The amount of and thickness of the conductor can be used to control the degree of phase shift. The greater the thickness, the greater the degree of phase shift. The phase shift may also be controlled by eliminating a portion of the conductive enclosure around the magnetic material. This may be accomplished by trimming an edge of the marker, breaking a portion of the conductive path or by splitting any of the conductive rings that may enclose the magnetic material.

The particulars of the phase locked oscillator, transmitter, receiver, antennas, phase comparator and downstream control equipment (alarms, cash registers, computers, etc.) are well known in the art. The dimensions of and choices among appropriate materials for the markers are capable of virtually infinite variation within the general scope of the invention, namely the generation and detection of phase shifted harmonics. The number of codes possible is theoretically infinite, but is of course limited by practical engineering constraints and system and component tolerances and costs.

This invention may be embodied in other specific forms without departing from the spirit or essential attributes thereof. Accordingly, reference should be made to the appended claims, rather than the foregoing specification, as indicating the scope of the invention.

What is claimed is:

1. An article surveillance system, comprising:

means for generating and transmitting phase locked reference signals in a detection zone;

a plurality of coded markers, each marker having means for generating harmonic signals of a predetermined phase shift responsive to the phase locked reference signals;

means for receiving the phase shifted harmonic signals generated by coded markers in the detection zone;

means for determining the relative phase shift between the reference signals and the harmonic marker signals; and, means for generating a control signal responsive to identification of a valid code by the determining means.

2. The surveillance system of claim 1, comprising means for comparing a determined relative phase shift to the predetermined phase shift, for enabling a yes/no detection signal to be generated by the control signal generating means.

3. The surveillance system of claim 1, comprising:

means for precisely measuring the degree of relative phase shift; and, means for generating a variable control signal corresponding to the measured degree of relative phase shift.

4. The surveillance system of claim 1, wherein each of the markers comprises means for adjusting the degree of phase shift at the harmonic signals.

5. The surveillance system of claim 4, wherein each of the markers comprises a core of soft magnetic material at least partly surrounded by an electrically conductive material, the degree of phase shift being proportional: to the amount and thickness of the electrically conductive material, relative to the amount of core material; to the configuration of the electrically conductive material; and, to the resistivity of the electrically conductive material.

6. The surveillance system of claim 1, wherein each of the markers comprises a core of soft magnetic material at least partly surrounded by an electrically conductive material.

7. The surveillance system of claim 1, wherein each of the markers comprises a core of soft magnetic material at least partly covered by an electrically conductive material.

8. The surveillance system of claim 1, wherein each of the markers comprises a core of soft magnetic material at least partly encased by an electrically conductive material.

9. A method for conducting surveillance of articles in a detection zone, comprising the steps of:

providing each article with a coded marker having means for generating harmonic signals of a predetermined phase shift responsive and relative to reference signals;

transmitting phase locked reference signals at a fundamental frequency into the detection zone;

receiving phase shifted harmonic signals generated by each marker in the detection zone responsive to the phase locked reference signals; and, measuring the phase shift between the reference signals and the harmonic marker signals, the degree of the phase shift being related to positive identification of a marker in the detection zone.

10. The method of claim 9, further comprising the step of generating a control signal responsive to identification of a coded marker in the detection zone.

11. The method of claim 9, further comprising the step of forming each of the markers from a core of soft magnetic material surrounded by an electrically conductive material.

12. The method of claim 11, further comprising the step of encoding the markers with different codes by: adjusting at least one of the amount of electrically conductive material relative to the amount of core material and the configuration of the electrically conductive material; and, choosing the electrically conductive material according to its characteristic resistivity, the degree of phase shift being proportional to each of the amount, the configuration and the resistivity.

13. The method of claim 9, comprising the step of generating a variable control signal corresponding to the measured degree of phase shift of the detected harmonic signals.

14. A magnetic marker for use in article surveillance systems wherein coded markers are carried by monitored articles, the marker comprising:

a core of soft magnetic material; and, an electrically conductive material at least partly surrounding the core, whereby the marker will generate a clearly identifiable harmonic signal of predetermined phase shift responsive and relative to a phase locked reference signal of a fundamental frequency, the degree of phase shift enabling reliable detection and identification of each coded marker.

15. The marker of claim 14, wherein the core material is chosen from permalloy and any metallic glass material.

16. The marker of claim 14, wherein the electrically conductive material is continuous.

17. The marker of claim 14, comprising discrete sections of electrically conductive material surrounding the core.

* * * * *